US005681686A

United States Patent [19]

Saito et al.

[11] Patent Number: 5,681,686

[45] Date of Patent: Oct. 28, 1997

[54] DESENSITIZING SOLUTION FOR OFFSET PRINTING

[75] Inventors: Hirotsuga Saito, Fujimi; Hayato Hyakutake; Mamoru Kidachi, both of Hino, all of Japan

[73] Assignee: Iwatsu Electric Co., LTD, Tokyo, Japan

[21] Appl. No.: 622,936

[22] Filed: Mar. 27, 1996

Related U.S. Application Data

[63] Continuation of Ser. No. 229,355, Apr. 18, 1994, abandoned.

[30] Foreign Application Priority Data

Apr. 20, 1993 [JP] Japan ..... 5-093318

[51] Int. Cl.[6] ..... G03C 5/00

[52] U.S. Cl. ..... 430/331; 430/309; 101/463.1; 101/450.1; 101/465; 101/451; 106/2

[58] Field of Search ..... 430/331, 309, 430/302, 300; 106/2; 101/463.1, 450.1, 465, 451

[56] References Cited

U.S. PATENT DOCUMENTS

| | | | |
|---|---|---|---|
| 3,617,266 | 11/1971 | Williams et al. | 96/1 |
| 4,734,132 | 3/1988 | Yoshida | 106/2 |
| 4,976,952 | 12/1990 | Lang et al. | 424/47 |

FOREIGN PATENT DOCUMENTS

| | | |
|---|---|---|
| 398416 | 5/1964 | Japan . |
| 4524609 | 8/1970 | Japan . |
| 144746 | 5/1992 | Japan . |
| 338372 | 12/1993 | Japan . |
| 1192602 | 5/1970 | United Kingdom . |
| 1198122 | 7/1970 | United Kingdom . |
| 1198123 | 7/1970 | United Kingdom . |

*Primary Examiner*—George F. Lesmes
*Assistant Examiner*—Laura Weiner
*Attorney, Agent, or Firm*—Paul & Paul

[57] ABSTRACT

This invention relates to a desensitizing solution for offset printing which is used for desensitizing an original plate for offset printing. The desensitizing solution of the present invention contains a basic aluminum chloride and/or its derivatives and glucosamine and/or its derivatives. This desensitizing solution can be used in combination with a desensitizing solution for offset printing which consists of phytic acid and its derivatives as the principal components.

3 Claims, No Drawings

DESENSITIZING SOLUTION FOR OFFSET PRINTING

This application is a continuation, of application Ser. No. 08/229,355, filed on Apr. 18, 1994, now abandoned.

BACKGROUND OF THE INVENTION

1. Field of the Invention

This invention relates to a desensitizing solution. More particularly, the present invention relates to a desensitizing solution for offset printing used for a desensitization treatment (hereinafter referred to as "desensitizing") of an original plate of offset printing. The desensitizing solution according to the present invention can be advantageously used for producing an original plate for electrophotographic printing (hereinafter referred to as the "master") having a photosensitive layer comprising a photoconductive powder of zinc oxide and a resin binder, for example.

2. Description of the Related Art

In the offset printing technology described above, there is known generally a printing method which applies a series of treatments such as charging, exposure, development and fixation to the surface of the photosensitive layer of the master to form a lipophilic image, then precesses non-image portions with a desensitizing solution so as to allow an ink to adhere to the lipophilic image, and finally transfers the image to paper. Here, the desensitizing solution is coated onto the surface of the master, to form a hydrophilic coating at the non-image portions and to thereby prevent adhesion of the oily ink on the non-image portions, as is well known in the art.

Various kinds of desensitizing solutions have been proposed, and have actually been used, for desensitizing. For example, Japanese Examined Patent Publication (Kokoku) No. 39-8416 discloses a desensitizing solution containing ferrocyanide or ferricyanide compounds as its principal components. The desensitizing solution of this kind has the advantages that its desensitization power is high and a hydrophilic coating having a high physical strength can be formed, but involves at the same time the problem that since the ferrocyanide or ferricyanide compounds as its principal components are unstable to light and heat, desensitization power drops with the passage of time. Further, the critical problem with this desensitizing solution is that it contains cyanic ions. Though the ferrocyanide or ferricyanide compounds per se are stable and are believed to be harmless to the human body, various environmental problems occur because they contain cyanic ions and free cyanogen is detected from their waste liquor at the time of disposal.

A desensitizing solution for avoiding the occurrence of free cyanogen (hereinafter referred to as the "cyan-free solution") has also been proposed. For example, Japanese Examined Patent Publication (Kokoku) No. 58-5799 and Japanese Unexamined Patent Publication (Kokai) No. 62-77994 teach a desensitizing solution which comprises a myoinositol hexaphosphate (hereinafter referred to as "phytic acid"). However, there occurs the problem that stain occurs in the non-image portions because the hydrophilic coating obtained by these desensitizing solutions does not have a sufficient physical strength. Particularly in the case of the desensitizing treatment using a desensitizing processor (an apparatus that automatically processes the offset master plate for desensitizing) which has been used in the past in this field of art, the desensitization power further drops.

A desensitizing solution, which, though it is a cyan-free solution, has a high desensitization power and forms a hydrophilic coating having a high physical strength, has also been proposed. For example, Japanese Unexamined Patent Publication (Kokai) No. 4-14476 describes a desensitizing solution consisting of basic aluminum chloride as its principal component. This desensitizing solution can form a hydrophilic coating having a high physical strength when it is used in combination with a desensitizing solution consisting of phytic acid as its principal component. However, even when these desensitizing solutions are used in combination, there remains a problem in the desensitizing treatment using the desensitizing processor in that the hydrophilic coating does not have a sufficient physical strength, and a stain occurs in the non-image portions.

SUMMARY OF THE INVENTION

It is therefore a main object of the present invention to provide a desensitizing solution which is free from the problems and drawbacks described above.

In other words, the technical problems to be solved by the present invention reside in the provision of an excellent desensitizing solution for offset printing which does not contain ferrocyanide and ferricyanide compounds which would otherwise cause environmental problems and would be degraded by light and heat, uses only harmless compounds as its constituent elements, and can form a hydrophilic coating having a high physical strength in non-image portions under any desensitizing condition.

The object of the present invention described above can be accomplished by a desensitizing solution for offset printing which contains a basic aluminum chloride as an inorganic ionic polymer and its derivatives, and glucosamine, as a kind of an amino sugar, and its derivatives. The desensitizing solution according to the present invention is used in combination with a desensitizing solution for offset printing which consists of phytic acid and its derivatives as its principal components.

In the desensitizing treatment in offset printing, the desensitizing solution must react with metal ions existing on the surface of the non-image portions of the plate and the resulting compounds must become water-insoluble hydrophilic compounds.

In the case of the master, zinc oxide on the surface is ionized (to $Zn^{2+}$) when the master is desensitized by the desensitizing solution which is an acidic solution, as is well known in the art. The zinc ions thus formed have characteristic properties such that they react with the principal components for water-attraction such as phytic acid and form a water-insoluble compound which is an essential condition for forming the desensitizing solution for offset printing.

A mixed solution of basic aluminum chloride and its derivatives and glucosamine and its derivatives improve the reaction efficiency between the zinc ions and phytic acid when it is used in combination with the desensitizing solution consisting principally of phytic acid, and can form a hydrophilic coating having a higher physical strength than the coating obtained by the conventional desensitizing solution consisting of phytic acid as its principal component.

Though basic aluminum chloride and its derivatives exhibit the effect when used alone, their effect can be synergistically improved when used in combination with glucosamine and its derivatives.

The basic aluminum chloride used in the present invention is an inorganic ionic polymer such as polyaluminum chloride (PAC), aluminum hydroxychloride, aluminum chlorohydroxide, hydroxyaluminum chloride, etc., and its structure is expressed by the general formula:

$$[Al_2(OH)_nCl_{6-n}]_m$$

where $0<n<6$, $m>1$.

Basicity differs depending on the values m and n.

Glucosamine is prepared by monomerizing chiton, chitosan, etc., as amino group-containing natural polymers, and its structural formula is given below:

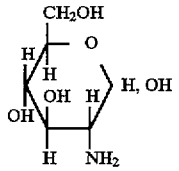

Examples of the derivatives of glucosamine are glucosamine chlorides, glucosamine sulfates, glucosamine lactates, and so forth.

Surprisingly enough, the inventors of the present invention have found out as a result of intensive studies that the desensitizing solution containing basic aluminum chloride and its derivatives, and glucosamine and its derivatives, exhibits an excellent effect when the master is desensitization.

In the desensitizing solution according to the present invention, basic aluminum chloride and its derivatives can be used either alone or in mixture, and the amount of use (the total amount when mixed) is from 0.1 to 50 wt% and preferably, from 5 to 30 wt%. The amount of use of glucosamine and its derivatives (the total amount when mixed) is from 0.01 to 20 wt% and preferably, from 0.1 to 10 wt%. When the amount is below these ranges, the strength of the hydrophilic coating decreases with a decreasing amount, and when it is above these ranges, the viscosity of the desensitizing solution rises, so that desensitization of detailed parts and thus adhesion of the ink becomes insufficient.

In the desensitizing solution according to the present invention, several kinds of basic aluminum chlorides and their derivatives, and several kinds of glucosamines and their derivatives, may be used in mixture. Furthermore, besides the basic aluminum chlorides and their derivatives and glucosamines and their derivatives, the desensitizing solution may arbitrarily contain various additives. Examples of useful additives include a pH adjusting agent, a pH buffer, a wetting agent, a penetrant, antiseptics, a rust proofing agent, and so forth. Organic and inorganic acids, hydroxides such as sodium hydroxide, and basic compounds, can be used as the pH adjusting agent. Alcohols, sorbitol, glycerine, gum arabic, etc., can be used as the wetting agent. Further, a surfactant can be used as the penetrant, salicylic acid, sodium dihydroacetate, etc., as the antiseptics, and ethylenediaminetetraacetic acid (hereinafter abbreviated to "EDTA"), amines, etc., as the rust proofing agent. Water-soluble polymers can be used for other purposes.

The desensitizing solution according to the present invention may be used in any desensitizing processor (an apparatus that automatically processes the offset master plate for desensitizing) so long as it has been used in this field of art. Furthermore, the characteristic features of the desensitizing solution can fully be exploited when the desensitizing solution is used for manual desensitizing (desensitizing manually, for example, by using wet absorbent cotton with the desensitizing solution).

The desensitizing solution to be used in combination with the desensitizing solution of the present invention can contain various compounds as its principal components or in other words, as the main agent for water-attraction.

When the desensitizing solution to be used in combination with the desensitizing solution of the present invention is a cyan-free solution, phytic acid and its derivatives can be used advantageously. The main agents for water-attraction other than phytic acid and its derivatives can also be used.

Phytic acid and its derivatives can be used in mixture with other main agents for water-attraction. If permissible, the desensitizing solution may be used in combination with a desensitizing solution containing a ferrocyanide or ferricyanide compound as the main agent for water-attraction.

DESCRIPTION OF THE PREFERRED EMBODIMENT

Hereinafter, a method of preparing a desensitizing solution used in the present invention will be illustrated, and the present invention will be described in further detail with reference to Examples thereof and to Comparative Examples.

Production Examples 1 to 5 represent the method of preparing the desensitizing solutions according to the present invention, and Production Examples 6 to 8 represent the method of preparing the desensitizing solution according to the prior art.

PRODUCTION EXAMPLE 1

A desensitizing solution was prepared in accordance with the following recipe.

| | |
|---|---|
| water | 685 parts |
| 50% solution of polyaluminum chloride ("Takivine #1500", a product of Taki Chemical Co.) | 300 parts |
| D-(+)-glucosamine hydrochloride | 5 parts |
| glycerine | 10 parts |
| total: | 1,000 parts |

pH measurement value: 4.23

PRODUCTION EXAMPLE 2

A desensitizing solution was prepared in accordance with the following recipe.

| | |
|---|---|
| water | 795 parts |
| 50% solution of polyaluminum chloride ("Vannoltan White", a product of Taki Chemical Co.) | 150 parts |
| D-(+)-glucosamine hydrochloride | 30 parts |
| malonic acid | 25 parts |
| total: | 1,000 parts |

pH measurement value: 3.51

PRODUCTION EXAMPLE 3

A desensitizing solution was prepared in accordance with the following recipe.

| | |
|---|---|
| water | 690 parts |
| 50% solution of polyaluminum chloride ("Takivine #1500", a product of Taki Chemical Co.) | 250 parts |
| glucosamine hydrochloride (a product of Taiyo Chemical Co.) | 50 parts |
| gum arabic | 10 parts |
| total: | 1,000 parts |

pH measurement value: 4.19

PRODUCTION EXAMPLE 4

A desensitizing solution was prepared in accordance with the following recipe.

| | |
|---|---|
| water | 410 parts |
| 50% solution of polyaluminum chloride ("Vannoltan White", a product of Taki Chemical Co.) | 500 parts |
| glucosamine hydrochloride (a product of Taiyo Chemical Co.) | 60 parts |
| tartaric acid | 30 parts |
| total: | 1,000 parts |

pH measurement value: 3.37

PRODUCTION EXAMPLE 5

A desensitizing solution was prepared in accordance with the following recipe.

| | |
|---|---|
| water | 590 parts |
| 50% solution of polyaluminum chloride ("PAC300M", a product of Taki Chemical Co.) | 150 parts |
| 50% solution of polyaluminum chloride ("Vannoltan White", a product of Taki Chemical Co.) | 200 parts |
| D-(+)-glucosamine hydrochloride | 30 parts |
| potassium aluminum sulfate | 30 parts |
| total: | 1,000 parts |

pH measurement value: 3.65

PRODUCTION EXAMPLE 6

A desensitizing solution was prepared in accordance with the following recipe.

| | |
|---|---|
| water | 670 parts |
| 50% solution of polyaluminum chloride ("Takivine #1500", a product of Taki Chemical Co.) | 300 parts |
| succinic acid | 10 parts |
| ethylene glycol monoethyl ether | 10 parts |
| inositol | 10 parts |
| total: | 1,000 parts |

pH measurement value: 4.03

PRODUCTION EXAMPLE 7

A desensitizing solution was prepared in accordance with the following recipe.

| | |
|---|---|
| water | 910 parts |
| phytic acid | 30 parts |
| malonic acid | 20 parts |
| adipic acid | 20 parts |
| ethylene glycol | 16 parts |
| EDTA-disodium | 4 parts |
| total: | 1,000 parts |

PRODUCTION EXAMPLE 8

A desensitizing solution was prepared in accordance with the following recipe.

| | |
|---|---|
| water | 889 parts |
| potassium ferrocyanide | 20 parts |
| ammonium phosphate | 60 parts |
| diammonium citrate | 30 parts |
| EDTA-disodium | 1 part |
| total: | 1,000 parts |

The pH value was adjusted to 4.50 by potassium hydroxide.

EXAMPLE

A printing test of each of the desensitizing solutions described above was carried out in the following way.

A form plate was produced by the use of an electronic processing machine (AP-10EX) manufactured by Iwasaki Tsushinki K.K., a master paper (EL-3) and a developing solution (AP-10 set). The form plate thus produced was treated with the desensitizing solution prepared by the Production Example given above, and printing was made by an offset press (AB Dick 350) manufactured by AB Dick Co., U.S.A. A printing ink "F Gloss Black #85" of Dai-Nippon Ink & Chemicals Co. was used as the printing ink and a solution U (diluted 10 times) of Iwasaki Tsushinki K.K. as used as the solution.

Desensitizing was effected using a desensitizing processor (an apparatus that automatically processes the offset master plate for desensitizing) of Ricoh Co. in accordance with the following sequence:

plate making→primary desensitizing (ES-1)→drying→secondary desensitizing (ES-2)→printing Example number and printing results (number of sheets in which stain occurred, and inking property) are tabulated in Table given below.

Examples and Printing Result

| | treating condition | | printing result | |
|---|---|---|---|---|
| Example | ES-1 | ES-2 | No. of non-stained | inking property |
| Example 1 | Production Example 1 | Production Example 7 | 5,000 or more | o |
| Example 2 | Production Example 2 | Production Example 7 | 5,000 or more | o |
| Example 3 | Production Example 3 | Production Example 7 | 5,000 or more | o |
| Example 4 | Production Example 4 | Production Example 7 | 5,000 or more | o |
| Example 5 | Production Example 5 | Production Example 7 | 5,000 or more | o |
| Example 6 | Production Example 2 | Production Example 8 | 5,000 or more | o |
| Example 7 | Production Example 3 | Production Example 8 | 5,000 or more | o |
| Comparative Example 1 | Production Example 6 | Production Example 7 | from 1,500 | Δ |
| Comparative Example 2 | Production Example 6 | Production Example 8 | from 2,000 | Δ |
| Comparative | Production | Production | from 100 | x |

-continued

Examples and Printing Result

| Example | treating condition ES-1 | treating condition ES-2 | printing result No. of non-stained | printing result inking property |
|---|---|---|---|---|
| Example 3 | Example 7 | Example 7 | | |
| Comparative Example 4 | Production Example 8 | Production Example 8 | from 750 | Δ |

NOTE:
1) Inking property was evaluated as follows: ○: good, Δ: not good, x: bad
2) ES-1: primary desensitizing solution
ES-2: secondary desensitizing solution As can be understood clearly from the results tabulated in the table given above, excellent printed matter could be obtained in Examples 1 to 7 using the desensitizing solutions (Production Examples 1 to 5) containing the basic aluminum chlorides and their derivatives, and glucosamine and its derivatives. According to Comparative Examples 1 to 4 using the desensitizing solutions (Production Examples 6 to 8) of the prior art consisting primarily of the basic aluminum chlorides and their derivatives, or the desensitizing solutions consisting primarily of phytic acid, the ferrocyanides and the ferricyanides, however, the strength of the hydrophilic coating was weak, and stain in the non-image portions was remarkable, so that satisfactory printed matter could not be obtained.

As described above, the desensitizing solution according to the present invention does not contain the ferrocyanide and ferricyanide compounds which would otherwise result in the environmental pollution and are deteriorated by light and heat, can form a hydrophilic coating having a high physical strength under any desensitizing condition, particularly in processor desensitizing, and has an excellent inking property at the image portions.

We claim:

1. An aqueous desensitizing solution for offset printing comprising a basic aluminum chloride and glucosamine selected from the group consisting of glucosamine chlorides, glucosamine sulfates and glucosamine lactates.

2. An aqueous desensitizing solution for offset printing according to claim 1, wherein said basic aluminum chloride is polyaluminum chloride.

3. An aqueous desensitizing solution for offset printing comprising a basic aluminum chloride and glucosamine, wherein said desensitizing solution consists essentially of from 0.1 to 50 weight percent of said basic aluminum chloride and from 0.01 to 20 weight percent of said glucosamine.

* * * * *